US007694429B2

(12) United States Patent
Duquette et al.

(10) Patent No.: US 7,694,429 B2
(45) Date of Patent: Apr. 13, 2010

(54) SHAKE JIG FOR INSTALLING SHAKE SIDING

(76) Inventors: Dan R. Duquette, 83 Careton Rd., Meredith, NH (US) 03253; Gerald F. Briggeman, III, 300 Pine St. Ext., Laconia, NH (US) 03246

( * ) Notice: Subject to any disclaimer, the term of this patent is extended or adjusted under 35 U.S.C. 154(b) by 68 days.

(21) Appl. No.: 12/178,125

(22) Filed: Jul. 23, 2008

(65) Prior Publication Data

US 2010/0018070 A1 Jan. 28, 2010

(51) Int. Cl.
*G01D 21/00* (2006.01)

(52) U.S. Cl. ..... 33/647; 33/649

(58) Field of Classification Search ..... 33/411, 33/646, 647, 648, 649
See application file for complete search history.

(56) References Cited

U.S. PATENT DOCUMENTS 159,597 A * 2/1875 Mefford ..... 33/647
1,115,202 A * 10/1914 Ingles ..... 33/646
4,155,175 A * 5/1979 Stiles ..... 33/646
4,936,021 A * 6/1990 Frenette et al. ..... 33/649
5,465,499 A * 11/1995 LaPlante ..... 33/647
2004/0221467 A1* 11/2004 Chillington ..... 33/649
2008/0301966 A1* 12/2008 Walther ..... 33/649

* cited by examiner

*Primary Examiner*—G. Bradley Bennett
(74) *Attorney, Agent, or Firm*—Davis & Bujold, P.L.L.C.

(57) ABSTRACT

A method and system for installing shakes on a building comprising a ledger board and a shake jig for assisting with installation of shakes. The shake jig comprising a base member supporting an adjustable member with a releasably fastener facilitating releaseable retention of the adjustable member in a desired relative position with respect to the base member. The base member has a shake shelf for abutting against a surface of a shake to prevent further insertion of the base member, between an installed topmost shake and an at least partially overlapped shake, and facilitate desired alignment of the shake jig with respect to the installed topmost shake. The adjustable member has a ledger shelf for engaging with the ledger board and retaining the ledger board in a desired horizontal orientation with respect to the shake shelf and assisting with installation of shakes.

20 Claims, 5 Drawing Sheets

SHAKE JIG FOR INSTALLING SHAKE SIDING

FIELD OF THE INVENTION

The present invention relates to a novel shake jig which facilitates installing shake siding to a building while ensuring that the bottom edges of each shake, in a horizontal row, are properly aligned with one another in a substantially horizontal plane and precisely spaced from the previously install row of horizontal shakes.

BACKGROUND OF THE INVENTION

A variety of different mechanisms and techniques are currently utilized by carpenters and/or installers when installing shakes, such as cedar shakes and the like, to a side of a building. One common technique is the use of a "snapped" horizontal chalk line extending from one edge of the building to the opposite edge of the building which is used as a guide when installing the shakes to the building. After a horizontal row of shakes is installed on the building using the "snapped" chalk line as a guide, another chalk line is then "snapped" to the side of the building for the next row and so forth until the entire side of the building has been sided with the shakes. This process is repeated for each side of the building. Such technique, although very accurate, is a quite cumbersome and time consuming and generally slows down installation process for the shakes to the building.

While there are a variety of other methods and processes which are known and utilized to assist with installing shakes to the siding of a building, none of them, heretofore, have been relatively simple and easy to use while also reducing the installation time and effort while still, at the same time, assisting reliable installation of shakes.

SUMMARY OF THE INVENTION

Wherefore, it is an object of the present invention to overcome the above noted drawbacks associated with the prior art techniques.

Another object of the present invention is to provide a shake jig which is relatively inexpensive to manufacture and easy to utilize while, at the same time, provides accurate and reliable installation of shakes to a side of a building.

A further object of the present invention is to provide a shake jig which is easy to insert between adjacent overlapped horizontal rows or layers of installed shakes so as to facilitate reliable retention of the shake jig to a wall of a building while also being easy to remove from the adjacent rows or layers of shakes, following installation of a desired section of shakes.

Yet another object of the present invention is to provide a shake jig with an adjustability feature which provides the installer with the ability to compensate for any unevenness of the shakes, the building and/or any other imperfections which are prevalent in a building or structure and hinder accurate installation of shakes to a building.

A still further object of the present invention is to permit adjustment of the relative position of the ledger shelf, relative to the shake shelf, to compensate for any unevenness of the shakes, the building and/or any other imperfections which are prevalent in a building or structure.

Yet another object of the present invention is to substantially double the installation speed of shakes, by using the shake jig, while still maintaining accurate installation of the shakes.

The present invention also relates to a shake jig for assisting with installation of shakes, the shake jig comprising: a base member supporting an adjustable member and a releasably fastener facilitating releaseable retention of the adjustable member in a desired relative position with respect to the base member; the base member having a shake shelf for abutting against a surface of a shake to prevent further insertion of the base member, between an installed topmost shake and an at least partially overlapped shake, and facilitate desired alignment of the shake jig with respect to the installed topmost shake; and the adjustable member having a ledger shelf for engaging with a ledger board and retaining the ledger board in a desired horizontal orientation with respect to the shake shelf and assisting with installation of shakes.

The present invention also relates to a system for installing shakes on a building, the system comprising: a ledger board; a shake jig for assisting with installation of shakes, the shake jig comprising: a base member supporting an adjustable member and a releasably fastener facilitating releaseable retention of the adjustable member in a desired relative position with respect to the base member; the base member having a shake shelf for abutting against a surface of a shake to prevent further insertion of the base member, between an installed topmost shake and an at least partially overlapped shake, and facilitate desired alignment of the shake jig with respect to the installed topmost shake; and the adjustable member having a ledger shelf for engaging with the ledger board and retaining the ledger board in a desired horizontal orientation with respect to the shake shelf and assisting with installation of shakes.

The present invention also relates to a method of installing shakes to a building via a ledger board and first and second shake jigs with each of the first and the second shake jigs comprising a base member supporting an adjustable member and a releasably fastener for facilitating releaseable retention of the adjustable member in a desired relative position with respect to the base member; the base member having a shake shelf for abutting against a surface of a shake to prevent further insertion of the base member, between an installed topmost shake and an at least partially overlapped shake, and facilitate desired alignment of the shake jig with respect to the installed topmost shake; and the adjustable member having a ledger shelf for engaging with the ledger board and retaining the ledger board in a desired horizontal orientation with respect to the shake shelf and assisting with installation of shakes, the method comprising the steps of: inserting a leading end of the first shake jig between an installed topmost shake and an at least partially overlapped shake; inserting a leading end of the second shake jig between another installed topmost shake and another at least partially overlapped shake such that the first shake jig is spaced from the second shake jig; supporting the ledger board on the ledger shelf of each of the first and the second shake jigs; arranging shakes to be installed on a top surface of the ledger board; and securing the shakes, arranged on the top surface of the ledger board, to the building.

BRIEF DESCRIPTION OF THE DRAWINGS

The invention will now be described, by way of example, with reference to the accompanying drawings in which.

DETAILED DESCRIPTION OF THE INVENTION

Figure 2:
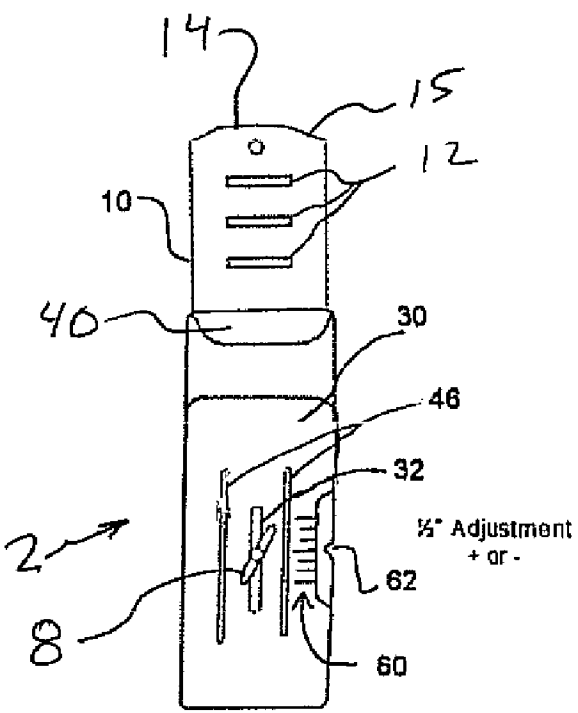
FIG. 2 is a front elevational view thereof.
Figure 1:
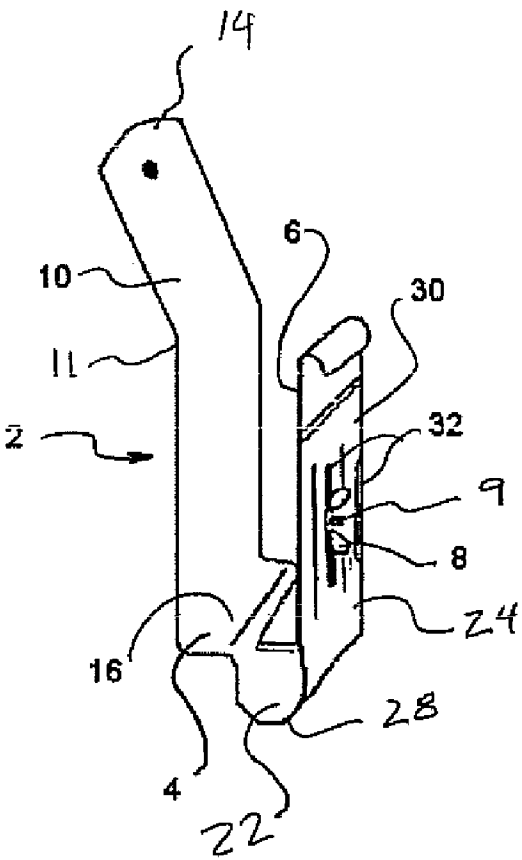
FIG. 1 is a diagrammatic perspective view of the shake jig according to the present invention.

Turning now to FIGS. 1-3, 5 and 5A, a detailed description concerning the various components of the shake jig 2 will now be provided. As can be seen in those Figures, the shake jig 2 generally comprises a base member 4 which supports and adjustable member 6 which is movable/slidable relative to the base member 4. A releasable fastener, e.g., a wing nut or nut 8 secured to a threaded shaft 9, facilitates releasably securing of the adjusted position of the adjustable member 6 relative to the base member 4.

Figure 3:
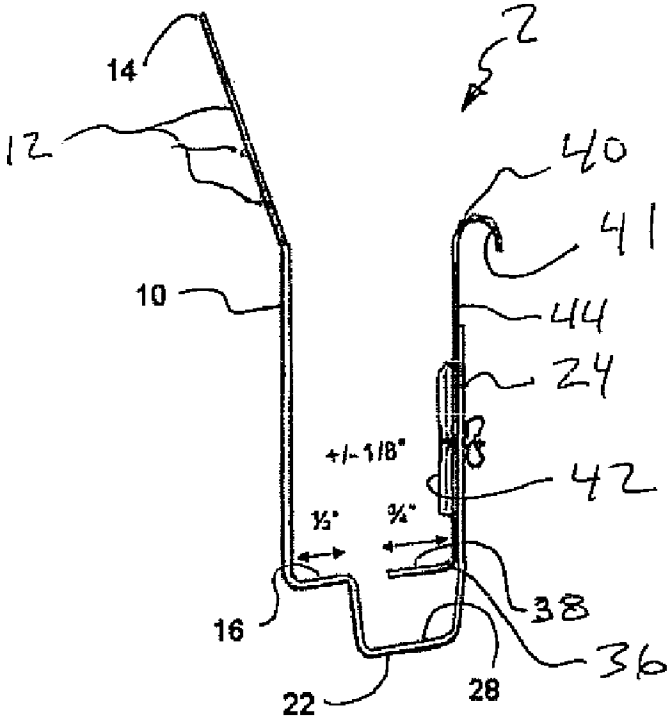
FIG. 3 is a side left elevational view thereof.

As can be seen if FIG. 3, a first section of the base member 4 is generally L-shaped and comprises an elongate clamping leg 10 which has a slight bend or camber 11 along its length adjacent a leading end 14 thereof, the purpose of which will become apparent in view of the following description. Due to the bend or camber 11 of the clamping leg 10, once the clamping leg 10 is inserted between an installed topmost shake 20 and an at least partially overlapped shakes 20'—as described below in further detail—the camber 11 of the clamping leg 10 is forced into a substantially planar configuration (see FIG. 7) and this straightening of the clamping leg 10, in turn, assists the clamping leg 10 with generating sufficient friction and/or pressure, between the topmost shake 20 and the at least partially overlapped shakes 20' so as to securely retain the shake jig 2 in its installed position, between such pair of partially overlapped shakes 20, 20', during use of the shake jig(s) 2.

To further assist with securely retaining the shake jig 2, between the topmost shake 20 and the at least partially overlapped shakes 20', a plurality of protrusions or gripping features 12 are formed on an outwardly facing surface 15 adjacent a leading end 14 of the clamping leg 10. The plurality of protrusions or gripping features 12 facilitate retention of the shake jig 2 in the installed position shown in FIGS. 6 and 7. Preferably between two to about twenty or so separate spaced apart protrusions or gripping features 12 are provided on the outwardly facing surface 15 of the clamping leg 10. The plurality of protrusions or gripping features 12 only project a small distance, e.g., between about 0.005 of an inch to about 0.250 of an inch and more preferably about 0.063 inches or so, from the outwardly facing surface 15 of the clamping leg 10 so as not to hinder insertion of the shake jig 2, between the topmost shake 20 and the at least partially overlapped shakes 20', but still assist with secure retention of the shake jig 2.

Figure 6:
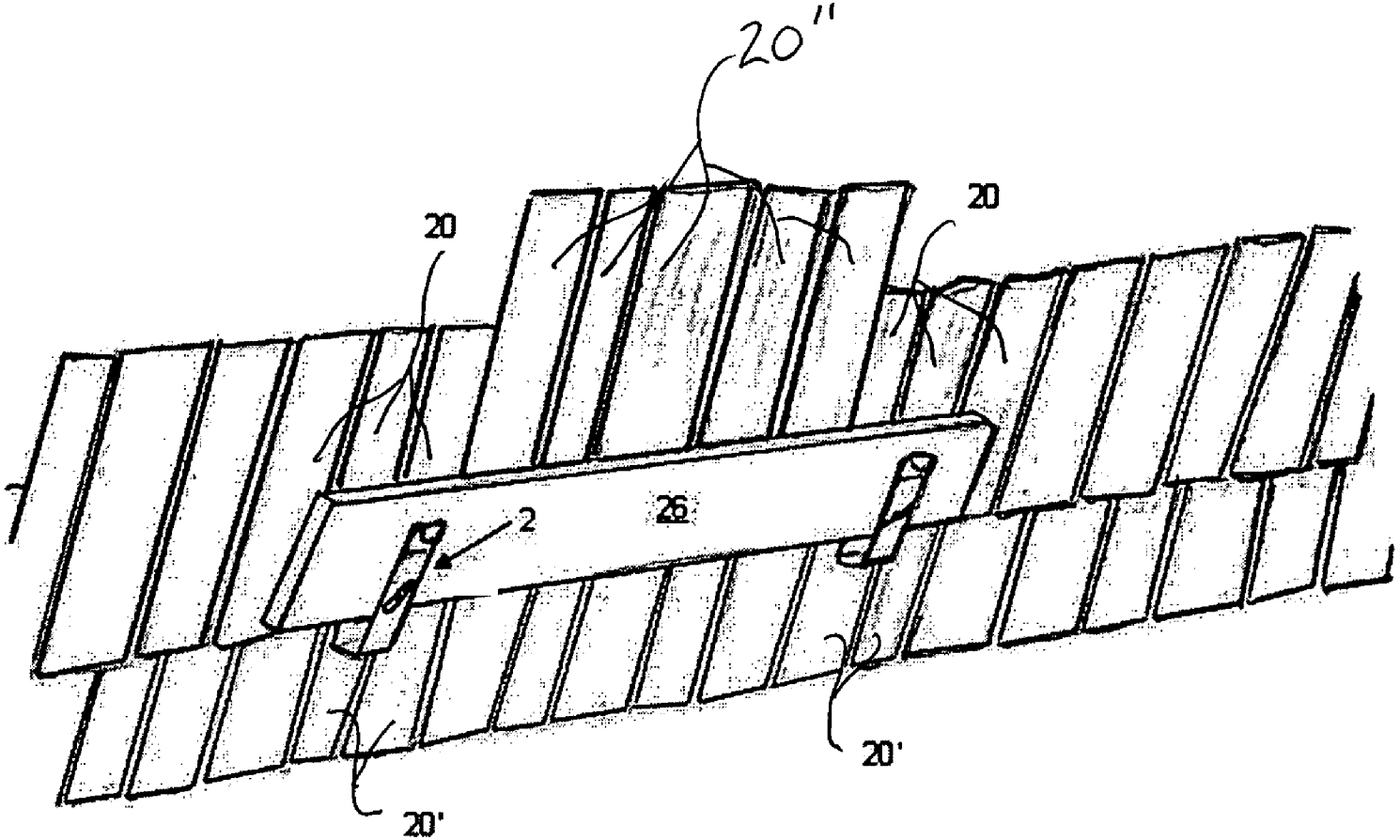
FIG. 6 shows a pair of spaced apart shake jigs supported by a pair of installed shakes with a ledger board being supported by and extending between the pair of shake jigs with a row of shakes, to be installed, resting on a top surface of the ledger board.
Figure 7:
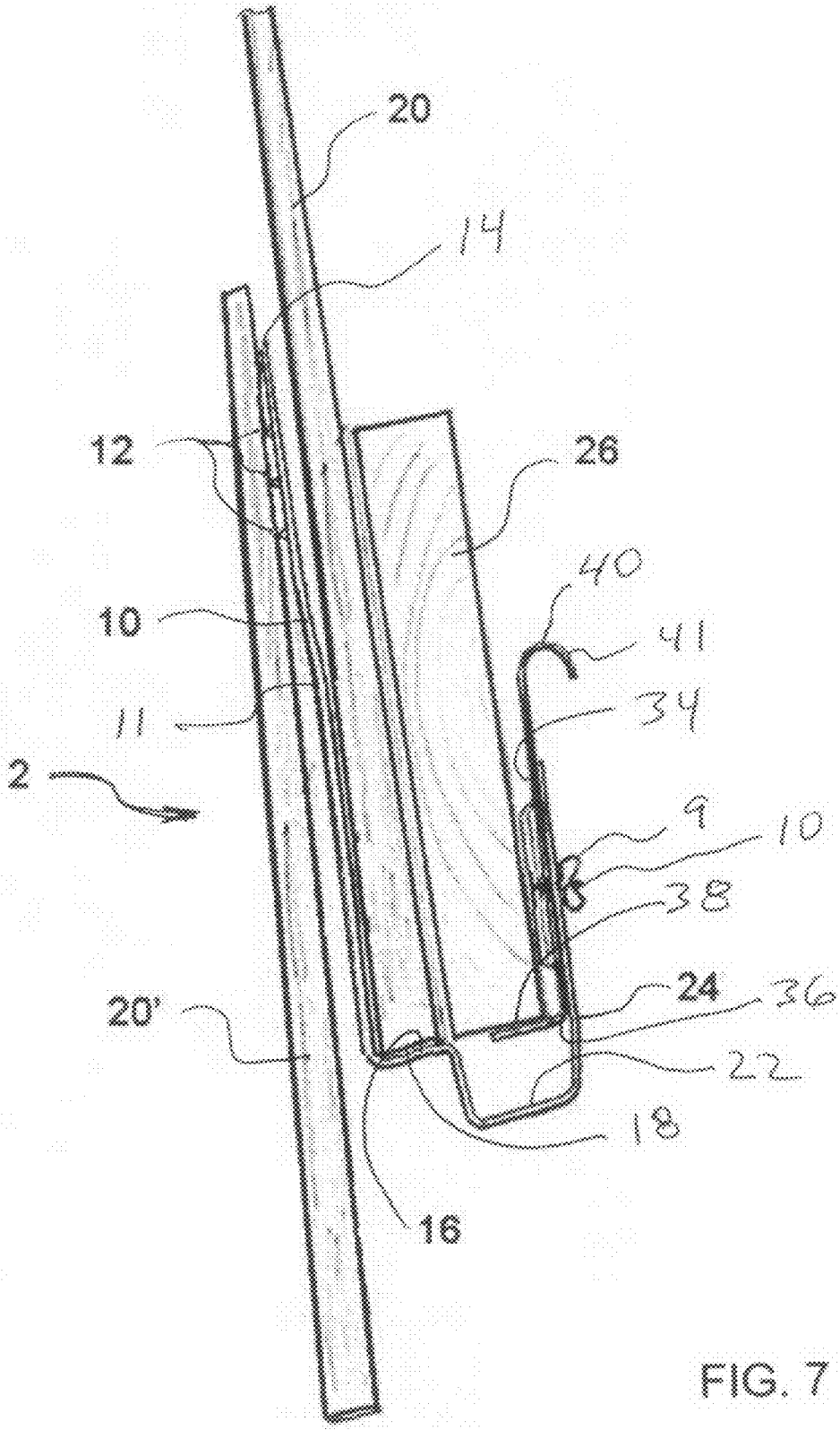
FIG. 7 is a diagrammatic side left elevational view showing engagement of the shake jig between a pair of adjacent overlapped rows of shake with a ledger board being supported by the ledger board.

The opposite end of the clamping leg 10 terminates in a sharp substantially right angle bend and this bent section of the base member 4 forms a shake shelf 16 which facilitates abutting the shake jig 2 against a lower downwardly facing surface 18 of the topmost installed shake 20, of a pair of partially overlapped shakes 20, 20', following installation of the shake jig 2 in the position shown in FIGS. 6 and 7.

A generally J-shaped section 22 is integrally formed with and interconnects the shake shelf 16 with a substantially planar support leg 24. The support leg 24 extends generally parallel to a lower section of the clamping leg 10, adjacent the shake shelf 16, but is spaced therefrom by a distance of about ¾ of an inch to about 1 and ¾ of an inch or so and more preferably is spaced therefrom by about 1¼ of an inch or so from one another. Such spacing of the support leg 24 from the clamping leg 10 must be sufficiently to allow a topmost shake 20 as well as a coarse or ledger board 26 to be located therebetween (see FIGS. 4 and 7) while still captively retaining those two components in a secure but releasable fashion. A U-shaped finger grip 28 is formed in the lower portion of the J-shaped section 22 which facilitates removing or withdrawing the shake jig 2 from the installed position shown in FIGS. 6 and 7 following installation of a desired section of shakes to the side of the building.

A remote end 30 of the support leg 24 has an elongate slot 32 (see FIG. 2 for example) formed therein and this elongate slot 32 receives one component of the releasable fastener, e.g., the threaded shaft, a bolt or a screw 9, for example. The elongate slot 32 permits sliding movement of the threaded shaft, a bolt or a screw 9 within and along the slot 32, the purpose of which will become apparent in view of the following description. The elongated slot 32 generally has a length of between ⅛ of an inch to about 1 inch or so and more preferably has a length of between ⅜ of an inch to about ¾ of an inch or so.

The mating releaseable fasteners, e.g., the threaded shaft, the bolt or the screw 9 and a mating nut or wing nut 8, for example, facilitate securing the adjustable member 6 to an inwardly facing surface 34 of the support leg 24 at a desired relative position. The end 36 of the adjustable member 6, normally located adjacent the generally J-shaped section 22, has a sharp substantially right angle bend which forms a ledger shelf 38 that extends inwardly toward and generally parallel to the shake shelf 16, but is spaced therefrom by a small distance so as to permit relative sliding movement between the ledger shelf 38 of the adjustable member 6 and the shake shelf 16 of the base member 4. The opposite end 40 of the adjustable member 6 extends generally parallel to the support leg 24 and terminates in a curvature which curves outwardly, away from the clamping leg 10, and this curved end forms a gripping area 41 for a finger of an installer to assist with adjusting the relative position between the adjustable member 6 and the base member 4 as well as facilitates insertion of a ledger board 26 on the ledger shelf 38.

The adjustable member 6 can either support a threaded rod or shaft 9 affixed to a sufficiently flat head 42 with the threaded rod or shaft 9 extending through a bore (not separately labeled) in the adjustable member 6, or alternatively threaded rod or shaft 9 can be fastened, e.g., welded, to an outwardly facing surface 44 of the adjustable member 6 with this threaded rod 10 being aligned with and extends through the elongate slot 32 and thereby facilitate adjustment of the adjustable member 6 and the base member 4.

Figure 5A:
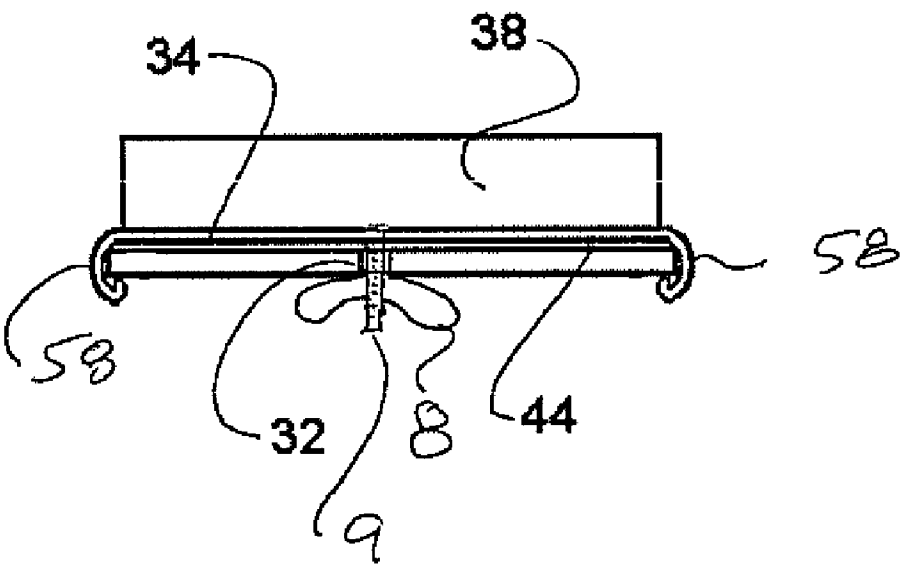
FIG. 5A is a cross-sectional view along section line of 5-5 of FIG. 2 showing a further embodiment for guiding the adjustable member.
Figure 5:
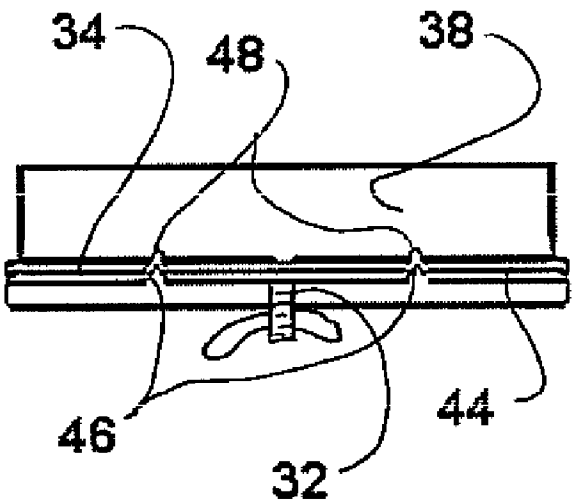
FIG. 5 is a cross-sectional view along section line of 5-5 of FIG. 2.

To assist with guiding the adjustable member 6 to and fro along the support leg 24, of the base member 4, so that a longitudinal axis of the adjustable member 6 remains substantially aligned and parallel with a longitudinal axis of the support leg 24 of the base member 4 and the ledger shelf 38 remains substantially parallel to the shake shelf 16, a section of the support leg 24 may be provided with at least one and more preferably a pair of spaced apart guide grooves, recesses and/or protrusions 46 while the adjustable member 6 is provided with one or more mating guide protrusions, grooves and/or recesses 48 (see FIG. 5). Alternatively, as can be seen in see FIG. 5A, one or both lateral sides of the adjustment member 6 may partially wrap around 58 either one or both opposed lateral sides of the support leg 24 to assist with guiding the adjustable member 6 along the support leg 24.

Preferably, as can be seen in FIG. 2, an outwardly facing surface of the support leg 24 of the base member 4, along the elongate slot 32, is provided with measurement scale or grid 60 while the adjustable member 6 carries an index finger or pointer 62, which cooperates with the measurement grid or scale 60, to display the relative position of the ledger shelf 38 with respect to the shake shelf 16 with a "0" position indicating that the shake shelf 16 and the ledger shelf 38 are precisely aligned with one another. The U-shaped finger grip 28, of the lower portion of the J-shaped section 22, ample space so that both the ledger shelf 38 and a portion of the ledger board 26 may be at least partially accommodated within the U-shaped finger grip 28 during use of the shake jig 2.

Use of the Shake Jig

Figure 4:
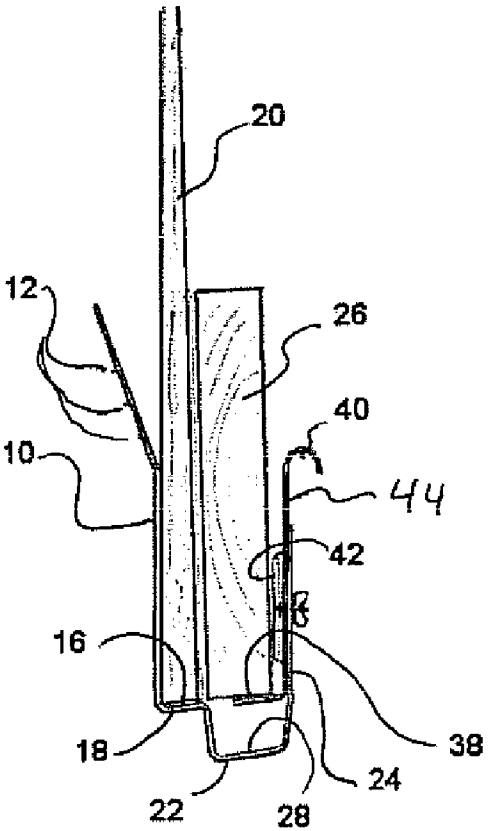
FIG. 4 is a side left elevational view showing engagement of the shake jig with both a shake and a ledger board.

With reference to FIGS. 4, 6 and 7, installation and use of the shake jig 2 will now be described. When use of the shake jig 2 is desired, the operator grabs a first shake jig 2 and inserts the leading end 14 of the clamping leg 10 between a topmost shake 20 and a shake 20' positioned adjacent but installed below and at least partially overlapped by the topmost shake 20 such that the leading end of the clamping leg 10 is sandwiched between those two adjacent shakes 20, 20'. The bend or camber 11 of the clamping leg 10, as well as the one or more plurality of protrusions or gripping features 12 facilitate retention of the shake jig 2 in the installed position between the two adjacent shakes 20, 20' as shown in FIG. 7. It is to be appreciated that the shake jig 2 is generally inserted sufficiently far so that the bottom lower downwardly facing surface 18 of the shake 20 abuts against the shake ledge 16. This ensures positioning and proper alignment of the shake jig 2 with the topmost shake 20.

One this is achieved, a second shake jig 2 is positioned, in a similar fashion in a spaced relationship to the first shake jig (e.g., between a pair of adjacent shakes 20, 20' such that the shake ledge 16 abuts against the respective bottom lower downwardly facing surface 18 of the topmost shake 20 as shown in FIG. 6). Typically the first and the second shake jigs 2 are spaced from one another by a distance of between about 2 feet to about 8 feet or so, depending upon the length of the course or ledge board. A ledger board 26 is then inserted and accommodated between the top most shakes 20 and the adjustable members 6 of the pair of spaced apart shake jigs 2 such that the lower edge of the ledger board 26 abuts with and is supported by the ledger shelf 38 of each of the pair of spaced apart shake jigs 2. Thereafter, the installer then places a plurality of the shakes 20" to be installed along the top surface 27 of the ledger board 26 and the installer is then able to rearrange and/or reposition the shakes 20" to be installed in a desired order, spacing, position and/or orientation in relation to the previously installed shakes and/or one another in accordance with the conventional siding practice. Once the shakes 20" to be installed, are suitably arranged on the top surface 27 of the ledger board 26, the installer then nails, screws or otherwise permanently fastens or secures the shakes 20" to be installed to the wall in a conventional manner.

Next, the installer removes the ledger board 26 from the pair of spaced apart shake jigs 2 and then places his/her index finger in the finger grip 28, formed in the lower J-shaped section 22 of each shake jig 2 and tugs in a vertically downward direction so that the clamping leg 10 is retracted and removed from its installed location between the pair of adjacent overlapped shakes 20, 20'. Once this occurs, the installer then repeats the above procedure by reinserting the first and the second shake jigs 2 in a sufficiently spaced relationship from one another at a different location along the wall of the building being sided, as described above. The process continues until the entire the building is sided with the shakes.

It is to be appreciated that the installer will occasionally, e.g., once every three to seven horizontal rows of installed shakes, run a chalk line from one edge of the building to the opposite edge of the building to ensure that the shake jig 2 is operating properly and no modification to the relative position, between the ledger shelf 38 and the shake shelf 16 is required. However, if the chalk line reveals any discrepancy, the installer can then adjust the relative position/orientation of one or both of the adjustment members 6 either to slightly increase or decrease the spacing between horizontal rows of shakes 20 and thereby compensate for any misalignment or installation discrepancies which may have occurred during the installation process.

Preferably the shake jig 2 is manufactured entirely from a resilient material such as spring steel, which provides increased resistance to bending and fatigue. It is to be appreciated, however, that alternatively the shake jig 2 can be manufactured from a variety of other materials, other than spring steel, e.g., such as plastic or the like. The important aspect of the shake jig 2 is that it is sufficiently rigid and durable to facilitate retention of the ledger board 26 in a desired horizontal orientation along a side of a building and facilitate support and installation of the shakes 20" to be installed.

The shake jig 2 typically has a width of between one-quarter of an inch or so to about five inches or so and more preferably has a width of between about one-half of an inch to about two inches. The shake jig 2 preferably has a thickness of between about 1/32 to about 1/8 of an inches and preferably about a 1/16 of an inch or so. The shake jig 2 typically has an overall length of between about three inches or so to about nine inches or so and more preferably has an overall length of between about five inches to about seven inches or so.

Although the releasable threaded fasteners is generally described as being a combination of a bolt and a wing nut 9, 8, it is to be appreciated that a variety of other kinds and types of conventional and well known releasable fasteners can be employed. The important aspect of the releasable fastener is that it allows adjustment of the relative position of the adjustable member 6, with respect to the base member 4, while still being able to retain those two members 4, 6 in a desired orientation and/or position with respect to one another.

The ledger board 26 preferably has a length of between about one foot to about sixteen feet of so and more preferably has a length of about two feet to about eight feet or so. It is to be appreciated that the ledger board 26 can be manufactured from a variety of other materials such as wood, plastic, metal, etc. According to the shown embodiment of FIGS. 1-7, the ledger board 26 is generally a wooden plank having a thickness of about three-quarters of an inch or so and also have constant desired width, e.g., a width of between about three inches to about 7 inches or so and preferably a width of about three and one half inches. The important aspect of the ledger board 26 is that the two opposed sides thereof be substantially parallel to one another so as to space any supported shakes 20" to be installed at a desired distance away from the pair of ledger supports carried by the shake jigs 2. It is to be appreciated that the width of the ledger board 26 determines the spacing of the bottom lower downwardly facing surface 18, of the set of the shakes 20" to be installed, from the bottom lower downwardly facing surface 18 of the previously installed shake 20.

Since certain changes may be made in the above described shake jig and installation method, without departing from the spirit and scope of the invention herein involved, it is intended that all of the subject matter of the above description or shown in the accompanying drawings shall be interpreted merely as examples illustrating the inventive concept herein and shall not be construed as limiting the invention.

We claim:

1. A shake jig for assisting with installation of shakes, the shake jig comprising:

a base member supporting an adjustable member and a releasably fastener facilitating releaseable retention of the adjustable member in a desired relative position with respect to the base member;

the base member having a shake shelf for abutting against a surface of a shake to prevent further insertion of the base member, between an installed topmost shake and an at least partially overlapped shake, and facilitate desired alignment of the shake jig with respect to the installed topmost shake; and the adjustable member having a ledger shelf for engaging with a ledger board and retaining the ledger board in a desired horizontal orientation with respect to the shake shelf and assisting with installation of shakes.

2. The shake jig according to claim 1, wherein a first leading section of the base member is L-shaped and comprises an elongate clamping leg which has a slight bend or camber along its length, and an opposite end of the clamping leg supports the shake shelf.

3. The shake jig according to claim 1, wherein the shake shelf extends substantially at a right angle to the clamping leg of the shake jig.

4. The shake jig according to claim 1, wherein at least one protrusion or gripping feature is formed on an outwardly facing surface of the clamping leg, adjacent a leading end thereof, to facilitate retention of the shake jig following insertion of the clamping leg between the installed topmost shake and the at least partially overlapped shake.

5. The shake jig according to claim 1, wherein a plurality of protrusions or gripping features are formed on an outwardly facing surface of the clamping leg, adjacent a leading end thereof, to facilitate retention of the shake jig following insertion of the clamping leg between the installed topmost shake and the at least partially overlapped shake.

6. The shake jig according to claim 1, wherein a section of the support leg has at least one guide feature and the adjustable member has at least one mating guide feature which cooperate with one another and assists with guiding movement of the adjustable member along the support leg such that a longitudinal axis of the adjustable member remains substantially aligned and parallel with a longitudinal axis of the support leg and the ledger shelf remains substantially parallel to the shake shelf.

7. The shake jig according to claim 1, wherein at least one lateral side of the adjustable member partially wraps around a lateral side of the support leg to assist with guiding the adjustable member along the support leg such that a longitudinal axis of the adjustable member remains substantially aligned and parallel with a longitudinal axis of the support leg and the ledger shelf remains substantially parallel to the shake shelf.

8. The shake jig according to claim 1, wherein a surface of the support leg is provided with a scale and the adjustable member carries a pointer, and the point cooperates with the scale to display a relative position of the ledger shelf with respect to the shake shelf.

9. The shake jig according to claim 8, wherein when the point points to a "0" position of the scale, this position indicates that the shake shelf and the ledger shelf are aligned with one another.

10. The shake jig according to claim 1, wherein a leading end of the adjustable member curves away from the clamping leg and to form a gripping surface for a finger of an installer to facilitate insertion of a ledger board on the ledger shelf and assist with adjusting a relative position between the adjustable member and the base member.

11. A system for installing shakes on a building, the system comprising:

a ledger board;

a shake jig for assisting with installation of shakes, the shake jig comprising:

a base member supporting an adjustable member and a releasably fastener facilitating releaseable retention of the adjustable member in a desired relative position with respect to the base member;

the base member having a shake shelf for abutting against a surface of a shake to prevent further insertion of the base member, between an installed topmost shake and an at least partially overlapped shake, and facilitate desired alignment of the shake jig with respect to the installed topmost shake; and the adjustable member having a ledger shelf for engaging with the ledger board and retaining the ledger board in a desired horizontal orientation with respect to the shake shelf and assisting with installation of shakes.

12. The shake jig according to claim 11, wherein a first leading section of the base member is L-shaped and comprises an elongate clamping leg which has a slight bend or camber along its length, and an opposite end of the clamping leg supports the shake shelf.

13. The shake jig according to claim 11, wherein the shake shelf extends substantially at a right angle to the clamping leg of the shake jig.

14. The shake jig according to claim 11, wherein at least one protrusion or gripping feature is formed on an outwardly facing surface of the clamping leg, adjacent a leading end thereof, to facilitate retention of the shake jig following insertion of the clamping leg between the installed topmost shake and the at least partially overlapped shake.

15. The shake jig according to claim 11, wherein a plurality of protrusions or gripping features are formed on an outwardly facing surface of the clamping leg, adjacent a leading end thereof, to facilitate retention of the shake jig following insertion of the clamping leg between the installed topmost shake and the at least partially overlapped shake.

16. The shake jig according to claim 11, wherein a section of the support leg has at least one guide feature and the adjustable member has at least one mating guide feature which cooperate with one another and assists with guiding movement of the adjustable member along the support leg such that a longitudinal axis of the adjustable member remains substantially aligned and parallel with a longitudinal axis of the support leg and the ledger shelf remains substantially parallel to the shake shelf.

17. The shake jig according to claim 11, wherein at least one lateral side of the adjustable member partially wraps around a lateral side of the support leg to assist with guiding the adjustable member along the support leg such that a longitudinal axis of the adjustable member remains substantially aligned and parallel with a longitudinal axis of the support leg and the ledger shelf remains substantially parallel to the shake shelf.

18. The shake jig according to claim 11, wherein a surface of the support leg is provided with a scale and the adjustable member carries a pointer, and the point cooperates with the scale to display a relative position of the ledger shelf with respect to the shake shelf.

19. The shake jig according to claim 18, wherein when the point points to a "0" position of the scale, this position indicates that the shake shelf and the ledger shelf are aligned with one another.

20. A method of installing shakes to a building via a ledger board and first and second shake jigs with each of the first and the second shake jigs comprising a base member supporting an adjustable member and a releasably fastener for facilitating releaseable retention of the adjustable member in a desired relative position with respect to the base member; the base member having a shake shelf for abutting against a surface of a shake to prevent further insertion of the base member, between an installed topmost shake and an at least partially overlapped shake, and facilitate desired alignment of the shake jig with respect to the installed topmost shake; and the adjustable member having a ledger shelf for engaging with the ledger board and retaining the ledger board in a desired horizontal orientation with respect to the shake shelf and assisting with installation of shakes, the method comprising the steps of:

inserting a leading end of the first shake jig between an installed topmost shake and an at least partially overlapped shake;

inserting a leading end of the second shake jig between another installed topmost shake and another at least partially overlapped shake such that the first shake jig is spaced from the second shake jig;

supporting the ledger board on the ledger shelf of each of the first and the second shake jigs;

arranging shakes to be installed on a top surface of the ledger board; and securing the shakes, arranged on the top surface of the ledger board, to the building.

* * * * *